US005295444A

United States Patent [19]

Irle

[11] Patent Number: 5,295,444

[45] Date of Patent: Mar. 22, 1994

[54] MULTI-AXLE RUNNING CARRIAGE

[75] Inventor: Rudolf Irle, Plettenberg, Fed. Rep. of Germany

[73] Assignee: Krupp Brüninghaus GmbH, Werdohl, Fed. Rep. of Germany

[21] Appl. No.: 955,659

[22] Filed: Oct. 2, 1992

[30] Foreign Application Priority Data

Oct. 18, 1991 [DE] Fed. Rep. of Germany ..... 4134597

[51] Int. Cl.[5] ..... B61F 5/52

[52] U.S. Cl. ..... 105/453; 105/199.1; 105/199.4; 105/226

[58] Field of Search ..... 105/157.1, 160, 179, 105/182.1, 197.1, 199.4, 202, 217, 226, 453, 199.1

[56] References Cited

U.S. PATENT DOCUMENTS

| | | | |
|---|---|---|---|
| 2,025,493 | 12/1935 | Anderson | 105/197.1 |
| 2,040,180 | 5/1936 | Martin | 105/197.1 |
| 2,050,642 | 8/1936 | Wolfe | 105/197.1 |
| 2,050,656 | 8/1936 | Goodspeed | 105/197.1 |
| 2,104,404 | 1/1938 | Shafer | 105/197.1 |
| 2,109,715 | 3/1938 | Zwiebel | 105/197.1 |
| 2,237,382 | 4/1941 | Woodling | 105/197.1 |
| 3,707,920 | 2/1973 | Germer | 105/453 |

FOREIGN PATENT DOCUMENTS

| | | | |
|---|---|---|---|
| 0004585 | 10/1979 | European Pat. Off. | 105/453 |
| 0339041 | 7/1921 | Fed. Rep. of Germany | 105/453 |

*Primary Examiner*—Mark T. Le

*Attorney, Agent, or Firm*—Meltzer, Lippe, Goldstein, Wolf, Schlissel & Sazer

[57] ABSTRACT

The invention relates to a multi-axle running carriage for rail vehicles having two longitudinally, extending cast side walls (1, 2) and a transverse connecting assembly which are disposed axisparallel between two axles (3, 4) and are connected to the side walls, the side walls (1, 2) and the transverse connecting assembly forming a substantially H-shaped running carriage frame bearing a spring-mounted vehicle frame which can be fitted on, the load transmitting transverse connecting assembly provided being a transverse leaf spring (9) which consists of a number of spring leaves (14–19) and which bears in its central zone the lower part (10) of a bogie pivot at the connection of the vehicle frame and which is retained by its ends in the side walls (1, 2).

11 Claims, 5 Drawing Sheets

MULTI-AXLE RUNNING CARRIAGE

BACKGROUND OF THE INVENTION

The invention relates to a multi-axle running carriage for rail vehicles, having two longitudinally extending cast side walls in which the axles are mounted and transverse connecting means which are disposed axis-parallel between two axles and are connected to the side walls, the side walls and the transverse connecting means forming a running carriage frame bearing a spring-mounted vehicle frame which can be fitted on.

The invention starts from a multi-axle running carriage taking the form of a double-axle running carriage which is known from European Patent 0009726 and in which the transverse connecting means are transverse rods attached to the side walls between and also in front of the axles to form a closed running carriage frame. The running mechanism is also suspended from leaf supporting springs and chain link hangers, the load being transmitted in the planes determined by the two rigid side walls as a rule produced in cast steel construction in which the axle bearings lie. The transverse connecting means do not take part in load transmission but merely ensure the rigid connection of the side walls in the axial direction.

In the rail vehicle bogie disclosed in European Patent 0031008, which is not in the same category, the forces resulting from the load are introduced similarly, namely between the two bearings on each side, although in this case the imposed load is directly borne by a central axis-parallel transverse support integrated in the running carriage frame. Side walls of the kind according to the present invention are not used, but the transverse support of fibre-reinforced plastics merges into four spring arms which spring the axles. This is an H-shaped running carriage frame and as a whole represents a construction which dispenses with the established cast side walls and requires a number of additional secondary steps to achieve a running carriage of lightweight construction.

Lightweight constructions are not very suitable for long heavy railway wagons, to which the invention in the first place relates, nor are they robust enough to satisfy the operating conditions over rough—i.e., uneven tracks.

It is an object of the invention to provide a multi-axle running carriage which is suitable for long heavy wagons used for transporting goods, including bulk goods, and which is robust in structure and simple to manufacture and assemble, but flexible enough to be able to follow unevenesses of the track.

SUMMARY OF THE INVENTION

According to the invention, therefore, the load-transmittin transverse connecting means is a transverse leaf spring which consists of a number of spring leaves and which bears in its central zone the lower part of a bogie pivot for the connection of the vehicle frame and which is mounted by its ends in the side walls.

However, apart from exceptions, as in the running carriage to which the preamble of the present application relates, in such a multi-axle running carriage according to the invention additional transverse connecting means are provided which do not receive the load, the side walls being interconnected in the axis-parallel direction rigidly but otherwise with slight torsion via at least one additional flexible spacing element disposed between the axles. Since the load is at least substantially transmitted via the transverse leaf spring, said spring must be hard enough and must also make a distinct contribution towards damping oscillations occurring during travel. This demand is more particularly met by the construction according to which the transverse leaf spring consists of a number of layers of individual springs disposed one beside the other. As a result, the dimensioning of the individual springs also falls within the range of existing spring production lines.

In a further feature of the invention to transfer transverse forces from the transverse leaf spring to the lower part of the bearing socket, the individual springs of the upper layer are correspondingly positively connected to the lower part; to transmit forces of acceleration and braking, the lower part of the bearing socket has a downwardly directed front attachment extending as far as the lower position and a corresponding rear attachment, the two attachments holding the individual springs together in their central zone; for the transmission of transverse forces from the transverse leaf spring to the side walls the ends of the transverse leaf spring are mounted with limited movability in the side walls; and for the transmission of forces of acceleration and braking each of the ends of all the individual-springs is disposed between two stops.

This feature of the invention enables a multi-axle running carriage to be constructed in which the individual springs of the transverse leaf springs are horizontally fixed in the side walls exclusively by the supporting depressions, and in the depressions by bearing against one another, the individual springs being held together in the centre by the lower part of the bogie pivot and under the force of the load, something which particularly simplifies the assembly of this construction according to the invention, which is free from spring shackles.

In the feature of another invention each of the ends of all the individual springs is formed into an upwardly open trough-formed segment which is disposed in a corresponding supporting depression in the associated side wall. The shells thus lying one inside the other transmit the transverse forces and give the transverse leaf spring and its individual springs the necessary freedom of movement.

In contrast, according to another variant each of the ends of all the individual springs forms a downwardly open trough-shaped depression which rests on a supporting pin of the associated side wall.

According to a possible feature of the invention, however, each of the ends of the transverse leaf spring has a rolled end which is pivotably attached to the lower end of a chain link pivotable on the side wall transversely of the direction of travel. Conveniently the individual springs of the transverse leaf spring are individual springs in the form of parabolic springs, so that the transverse leaf spring itself is also substantially a parabolic spring. According to another variant at least two layers of two to four individual springs disposed one beside the other are provided, and it is also possible for all the individual springs to be of identical parabolic spring construction.

In the case of high railway wagons—i.e., wagons having a high centre of gravity—a feature of the invention is particularly advantageous, which relates to a multiaxle running carriage wherein disposed between each of the side walls and the vehicle frame is a leaf spring which is disposed parallel with the side walls and which bears via a leaf spring end against a slider of the vehicle frame. These two leaf springs can perform two functions; on the one hand they contribute towards stabilizing rolling motion, while on the other hand they stabilize by friction in the case of unstable running behaviour and also exert some damping action.

DESCRIPTION OF THE DRAWINGS

Embodiments of the invention are shown in the annexed drawings, wherein.

DETAILED DESCRIPTION OF THE DRAWINGS

Figure 1:
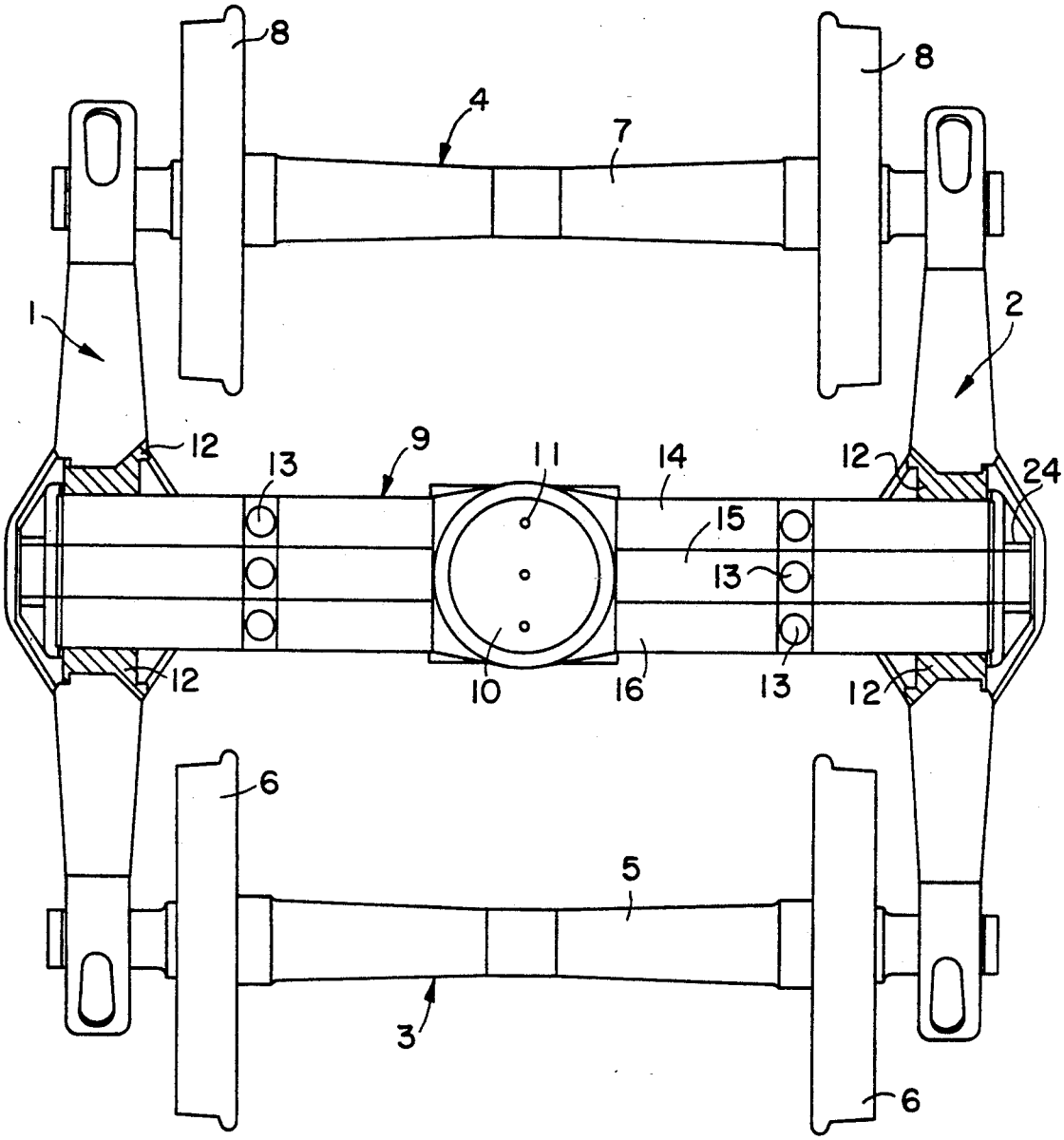
FIG. 1 is a plan view of a double-axle running carriage.

FIG. 1 is a plan view of a multi-axle running carriage for rail vehicles, namely a double-axle running carriage having two longitudinally extending cast steel side walls having two sets of wheels 3 and 4. The axle 5 with the wheels 6 and the axle 7 with the wheels 8 are mounted in the side walls 1, 2.

The load-transmitting transverse connecting means for the two side walls 1, 2 is a strong transverse leaf spring 9 bearing the lower part 10 of a bogie pivot. Pins 11 are provided on the lower part 10 of the bearing socket for the transmission of transverse forces to the transverse leaf spring 9. Each of the ends of the transverse leaf spring 9 is disposed between two stops 12 of the side walls 1, 2.

Six stabilizers 13 are provided as additional safety means.

Figure 2:
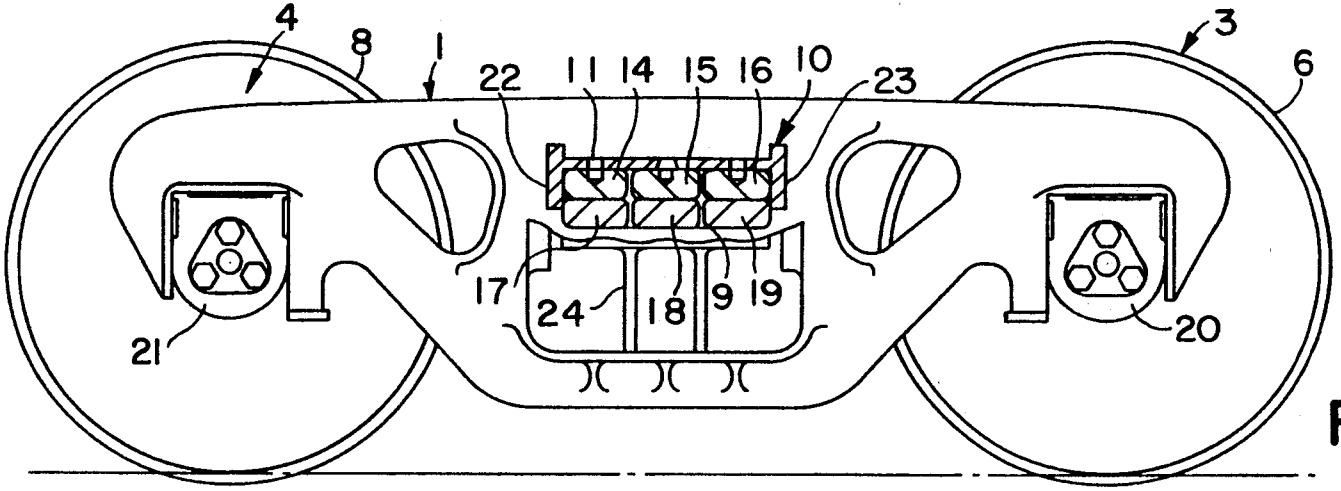
FIG. 2 is a side elevation of the running carriage shown in FIG. 1, partially opened up in the longitudinal central plane.
Figure 3:
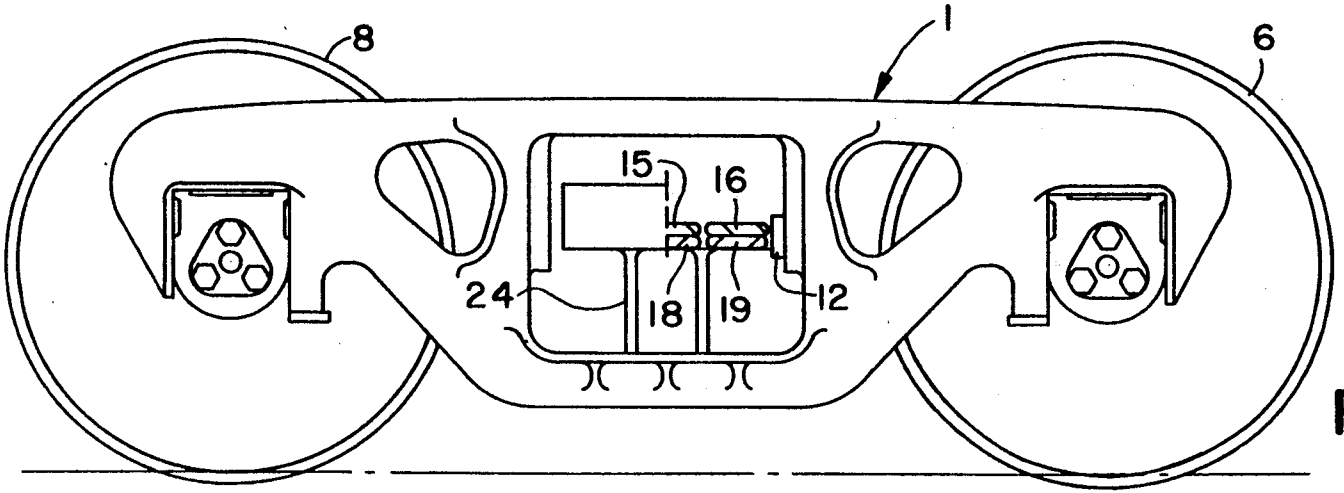
FIG. 3 is another side elevation, partially opened up in the axle bearing plane.

The transverse leaf spring 9 comprises individual springs 14, 15 and 16 and also, as shown in FIGS. 2 and 3, further individual springs 17, 18 and 19. The transverse leaf spring 9 therefore consists of an upper layer with the individual springs 14, 15 and 16 and a lower layer with the individual springs 17, 18 and 19. In FIG. 2 the individual springs 14–19 are sectioned in the central zone, so that it can be seen that the pins 11 let into the lower part 10 of a bearing socket engage in corresponding holes in the upper layer of the individual springs 14–16.

In FIG. 3 the individual springs 15, 16, 18 and 19 are shown sectioned in the zone of the side wall 1. The different thicknesses in the leaf springs in FIG. 2 as against FIG. 3 themselves indicate that the individual springs 14–19 must be parabolic spring leaves.

FIGS. 2 and 3 also show bearing arrangements 20 and 21 for the bearing of the two sets of wheels 3 and 4 in the side wall 1.

The individual springs 14–19 of the transverse leaf spring 9 are substantially held together in their central zone in the direction of travel by the lower part 10 of the bogie pivot which has for this purpose and for the transmission of forces of acceleration and braking a front attachment 22 extending downwardly as far as the lower layer and a corresponding rear attachment 23.

No screwed or welded connections are provided, since the load of a supporting frame holds everything together.

Lastly, FIGS. 2 and 3 show a flexible spacing element 24 which consists of two parallel plates which are torsionally flexible but otherwise stiff. The parallel plates of spacing element 24 strengthen the side walls 1 and 2 in the axis-parallel direction, but otherwise interconnect said walls with slight torsional distortion so that the walls can follow the usual unevenness of the track. However, the spacing elements 24 are not necessary to enable the multi-axle running carriage to operate. They are merely used for a special form to be disclosed hereinafter.

Figure 4:
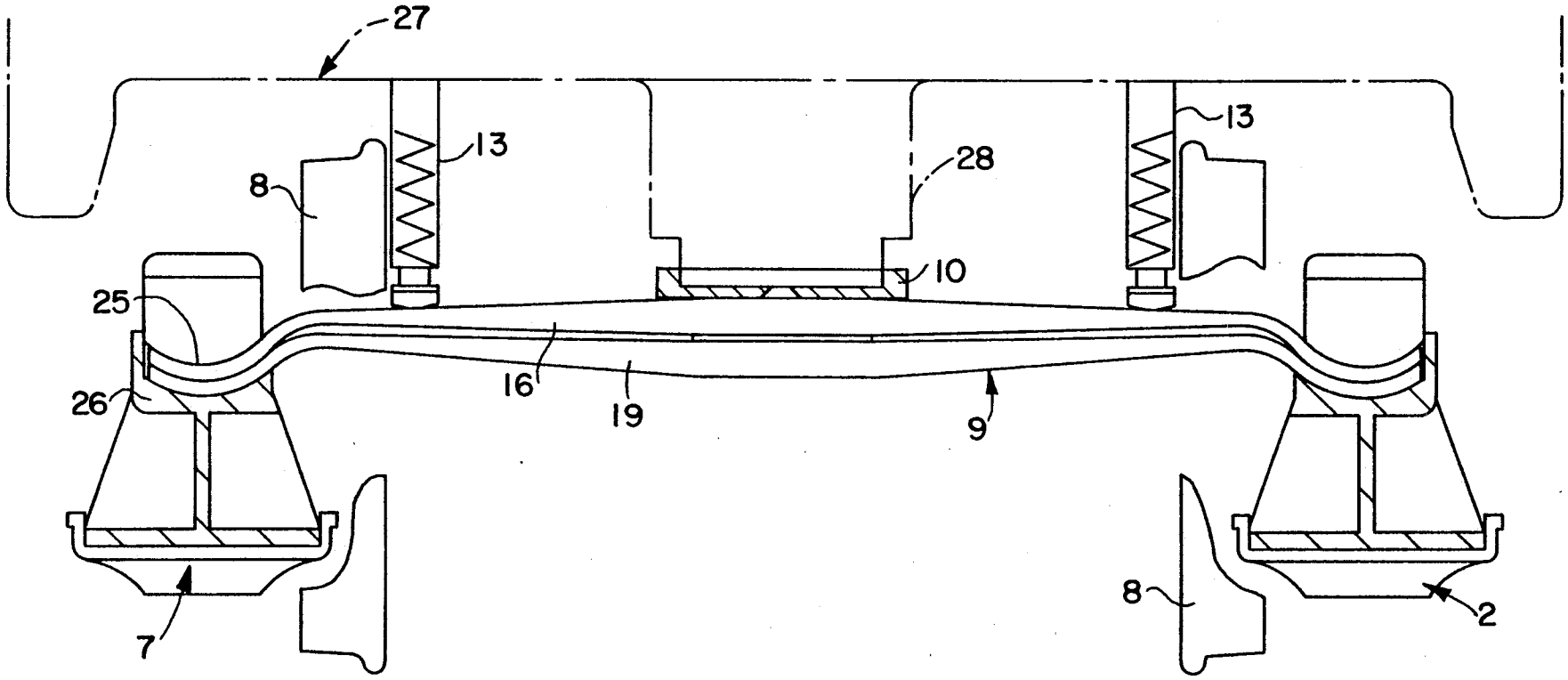
FIG. 4 is a cross-section through a multi-axle running carriage of a railway wagon.
Figure 5:
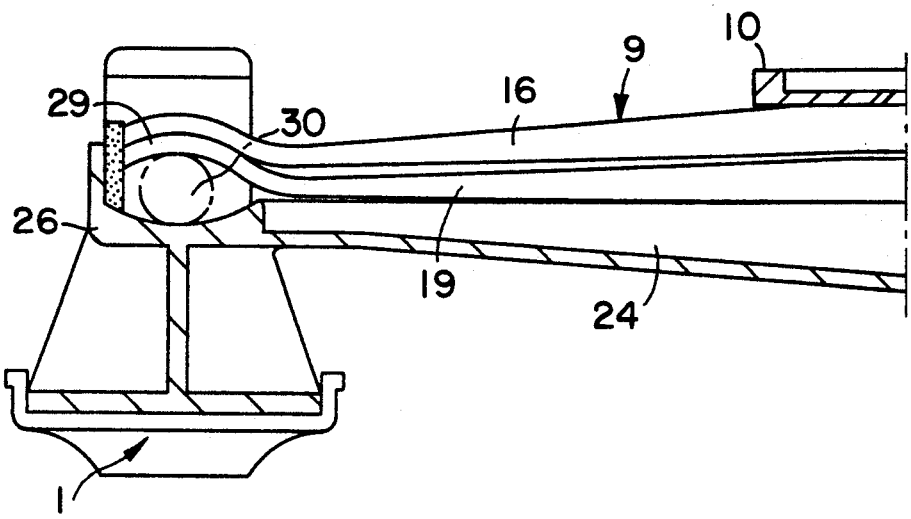
FIG. 5 shows a construction of the end bearing of the transverse leaf spring.
Figure 6:
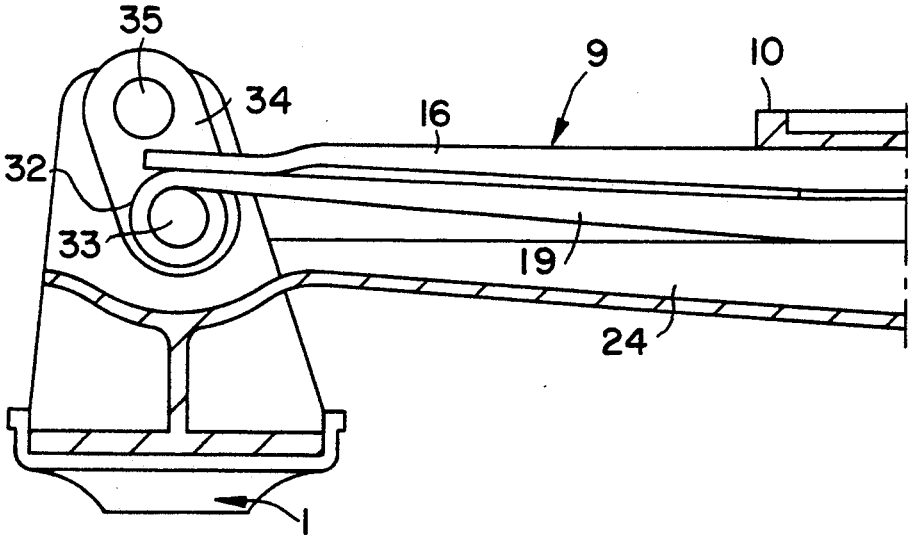
FIG. 6 shows another construction of the end bearing of the transverse leaf spring.

FIGS. 4, 5 and 6 mainly relate to the bearing of the ends of the transverse leaf spring 9 in the side walls 1 and 2.

Thus, FIG. 4 shows how each of the ends of all the individual springs 14–19 (the individual springs 16 and 19 are shown) is shaped into an upwardly open trough-shaped segment 25 which lies in a correspondingly shaped supporting depression 26 in the associated side wall 1, 2. In practice cast side walls coming from different running carriage constructions are used which often have such supporting depressions, in which case the ends of the transverse leaf spring 9 are suitably adapted to the existing supporting depressions.

FIG. 4 also shows the stabilizers 13 inserted between a vehicle frame 27 (shown in chain lines) and also upper part 28 of the bogie pivot engaging in the lower part 10.

FIG. 5 shows how the ends of all the individual springs 14–19 (the individual springs 16 and 19 are shown) is shaped into a downwardly open trough-shaped depression 29 which rests on a supporting pin 30 of the associated side wall 1, 2. Here again the supporting pin 30 is disposed in a supporting trough 26 in the side wall 1. A transverse stop 31 of, for example, a hard elastomer is provided for the springing of the transverse forces and the centering of the transverse leaf spring 9 when a deflection has taken place.

The special form of lateral attachment of the transverse leaf spring 9 shown in FIG. 6, which requires an additional spacing element 24, provides at the end of the transverse leaf spring 9, namely at the end of the individual springs 17, 18 and 19 (the individual spring 19 is shown) a rolled end 32 wrapped around a retaining pin 33 of a chain link 34. The chain link 34 can pivot on the side wall 1 around another pin 35.

Figure 7:
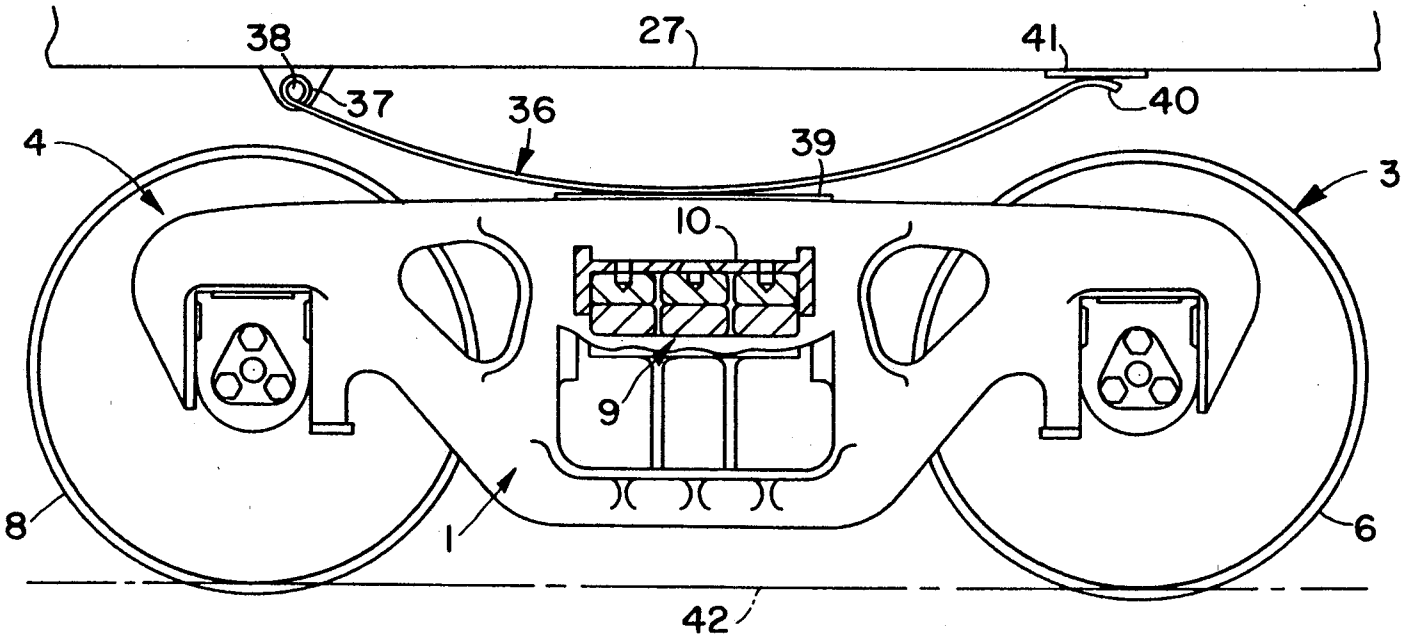
FIG. 7 is a side elevation of a double-axle running carriage having an additional leaf spring between the side wall and the vehicle frame.

The double-axle running carriage shown in FIG. 7 also has for stabilization a leaf spring 36 having on one side a rolled end 37 disposed to pivot around a pin 38 of the vehicle frame 27. The leaf spring 36 is prestressed and bears on the one hand in the direction of travel displaceably against a sliding element 39 of the side wall 1, while on the other hand the free leaf spring end 40 bears against a slider 41 of the vehicle frame 27. A rail is indicated by a chain-dot line 42.

We claim:

1. A multi-axle running carriage for supporting a vehicle frame of a rail vehicle, consisting essentially of first and second cast side walls extending in a longitudinal direction, first and second axles mounted in said side walls and extending in an axial direction which is transverse to said longitudinal direction, and a transverse leaf spring assemblage disposed between said first and second axles and extending in aid axial direction, said leaf spring assemblage comprising a plurality of individual leaf springs, each of said leaf springs having a central zone which is connected to a lower part of a bogie pivot of said vehicle frame and first and second ends which are mounted in said first and second side walls, said first and second walls and said transverse leaf spring assemblage constituting a running carriage frame in which only said leaf springs bear said vehicle frame.

2. The multi-axle running carriage of claim 1, further comprising at least one torsionally flexible spacing element disposed between said first and second axles and rigidly interconnecting said first and second sidewalls in said axial direction.

3. The multi-axle running carriage of claim 1, wherein said transverse leaf spring assemblage comprises a plurality of layers of individual leaf springs, said layers being disposed one beside another in said longitudinal direction.

4. The multi-axle running carriage of claim 3, wherein said lower part of said bogie pivot includes a bearing socket, said individual leaf springs of a topmost layer of said transverse leaf spring assemblage being positively connected to said lower part of said bogie pivot in order to transmit transverse forces from said transverse leaf spring assemblage to said lower part, wherein said lower part of said bogie pivot has a downwardly directed front attachment and a downwardly directed rear attachment, said individual leaf springs being held together in their central zones between said front and rear attachments to transmit acceleration and breaking forces from said transverse leaf spring assemblage to said lower part, wherein said first and second ends of said leaf springs are mounted with limited moveability in said sidewalls to transfer transverse forces from said transverse leaf spring assemblage to said sidewalls, and wherein the ends of said individual leaf springs are disposed between first and second stops in each of said first and second sidewalls to transmit acceleration and braking forces from said transverse leaf spring assemblage to said sidewalls.

5. The multi-axle running carriage of claim 1, wherein each of the ends of said individual leaf springs includes an upwardly open trough-formed section which is disposed in a corresponding supporting depression of an associated sidewall.

6. The multi-axle running carriage of claim 1, wherein each of the ends of said individual leaf springs has a downwardly open trough-shaped depression which rests on a supporting pin of an associated sidewall.

7. The multi-axle running carriage of claim 1, wherein each of the ends of said individual leaf spring is a rolled end pivotally attached to a lower end of a chain link which is pivotable on an associated sidewall.

8. The multi-axle running carriage of claim 1, wherein each of said individual leaf springs is a parabolic spring which is thicker in its central zone than at its ends.

9. The multi-axle running carriage of claim 8, wherein each of said leaf springs is of identical parabolic spring construction.

10. The multi-axle running carriage of claim 1 comprising at least two layers of individual leaf springs, wherein said layers are disposed on one beside another in said longitudinal direction, and each of said layers comprises two to four individual leaf springs.

11. The multi-axle running carriage of claim 1 further comprising an additional leaf spring disposed between each of said sidewalls and said vehicle frame, and extending in a direction which is parallel to said sidewalls, said additional leaf spring including a leaf spring end which bears against a slider of said vehicle frame.

* * * * *